US012116863B2

(12) United States Patent
Beach et al.

(10) Patent No.: US 12,116,863 B2
(45) Date of Patent: Oct. 15, 2024

(54) CHECK VALVE, ASSOCIATED DOWNHOLE DATA COLLECTION SYSTEM AND INNER CORE

(71) Applicant: REFLEX INSTRUMENTS ASIA PACIFIC PTY LTD, Balcatta (AU)

(72) Inventors: Andrew Phillip Beach, Balcatta WA (AU); Nigel Warwick Gaylard, Balcatta WA (AU); Timothy Merle Price, San Luis Obispo, CA (US); Richard Kabzinski, Balcatta WA (AU); James Barry Reilly, Balcatta WA (AU)

(73) Assignee: REFLEX INSTRUMENTS ASIA PACIFIC PTY LTD, Balcata (AU)

( * ) Notice: Subject to any disclaimer, the term of this patent is extended or adjusted under 35 U.S.C. 154(b) by 214 days.

(21) Appl. No.: 17/580,378

(22) Filed: Jan. 20, 2022

(65) Prior Publication Data

US 2022/0145724 A1 May 12, 2022

Related U.S. Application Data

(63) Continuation of application No. 16/850,297, filed on Apr. 16, 2020, now Pat. No. 11,255,156, which is a continuation of application No. 15/873,380, filed on Jan. 17, 2018, now Pat. No. 10,648,282.

(30) Foreign Application Priority Data

Mar. 3, 2017 (AU) ..... 2017900745

(51) Int. Cl.

| | |
|---|---|
| ***E21B 34/08*** | (2006.01) |
| ***E21B 25/00*** | (2006.01) |
| ***E21B 25/02*** | (2006.01) |
| ***E21B 41/00*** | (2006.01) |

(52) U.S. Cl.
CPC ..... *E21B 34/08* (2013.01); *E21B 25/02* (2013.01); *E21B 25/00* (2013.01); *E21B 41/0085* (2013.01)

(58) Field of Classification Search
CPC ..... E21B 25/00–18; E21B 10/02
See application file for complete search history.

(56) References Cited

U.S. PATENT DOCUMENTS

2008/0156477 A1* 7/2008 Aivalis ..... E21B 41/0085 166/53
2011/0049901 A1* 3/2011 Tinnen ..... E21B 41/0085 290/54
2015/0300162 A1* 10/2015 Drenth ..... E21B 25/16 175/44

* cited by examiner

*Primary Examiner* — Kristyn A Hall
(74) *Attorney, Agent, or Firm* — Felix L. Fischer

(57) ABSTRACT

An inner core barrel assembly incorporates an inner core tube. A body is connected to the inner core tube with a coupling mechanism. The coupling mechanism is configured to maintain a fixed rotational orientation with the inner core tube. The body includes a flow path for liquid within the inner core tube to flow as the inner core barrel assembly descends through a drill string. a core orientation system is contained within the body and positioned within the inner core tube.

11 Claims, 6 Drawing Sheets

CHECK VALVE, ASSOCIATED DOWNHOLE DATA COLLECTION SYSTEM AND INNER CORE

REFERENCES TO RELATED APPLICATIONS

This application is a continuation of U.S. application Ser. No. 16/850,297 filed on Apr. 16, 2020 which is a continuation of U.S. application Ser. No. 15/873,380 filed on Jan. 17, 2018 (now issued as U.S. patent Ser. No. 10/648,282) claiming priority to Australian patent application No. 2017900745 filed on Mar. 3, 2017, all entitled CHECK VALVE, ASSOCIATED DOWNHOLE DATA COLLECTION SYSTEM AND INNER CORE BARREL ASSEMBLY and all having a common assignee with the present application, the entire contents of which are incorporated herein by reference.

BACKGROUND

Field

A check valve, associated downhole data collection system and inner core barrel assembly each of which may be used in a core drilling system are disclosed. The check valve incorporates the data acquisition system. This downhole data collection system may be configured to provide core orientation information. The check valve and downhole data collection system may themselves be incorporated in the inner core barrel assembly.

Related Art

A core drill is used to extract the core samples of the earth for analysis by a geologist. The core drill is typically composed of a number of drill pipes which are connected end to end to form a drill string. An outer barrel assembly is attached to a downhole end of the drill string and includes a core bit for drilling the core sample. An inner core barrel assembly is run down the drill string and releasably latched inside the outer barrel assembly. The unit core barrel assembly includes a head assembly, a swivel, and an inner core barrel. The swivel attaches the head assembly to the inner core barrel in a manner which rotationally decouples the inner core barrel from the drill string. Therefore as the drill string rotates the inner core tube assembly is rotationally stationary and receives the core sample being cut by the drill bit.

The core orientation system is provided in the inner core barrel assembly. The core orientation system logs or records the in situ orientation of the core sample. This is used by the geologist to enable accurate mapping of geology and mineralogy of the earth. The core orientation system may be housed or attached at various locations within the inner core barrel assembly. However it is important for the core orientation system to have a fixed and known rotational relationship with the inner core tube.

An inner core barrel assembly usually also includes a check valve downhole of the spindle. The purpose of the check valve is to allow fluid and in particular liquid to pass through the inside of the inner core tube and then to the outside of the head assembly when the inner core barrel assembly is being run down the drill string for releasable locking to the outer core barrel assembly. Allowing this flow and subsequent bypass of fluid reduces the time taken for the inner core barrel assembly to which the inner core barrel assembly. Given that the drill holes can be of a debt substantially greater than I km and filled with water or drilling mud the descent time can be substantial. Reducing the descent time enables more meters to be drilled per day and thereby decreases operational costs. A common check valve has a ball valve, a ball seat and one or more openings or bypass passages spaced from the seat. When the inner core barrel assembly descends through liquid, the liquid pass up the inner core tube, forces the ball valve off the seat and flows out of the inner core tube through the openings or bypass passages. Once the inner core barrel assembly has landed fluid pressure can be provided from the surface which now flows through the openings/bypass passages and forces the valve ball onto the valve seat. Thereafter the fluid pressure can act on the inner core barrel assembly to achieve various effects or operate subsystems within the assembly.

The above references to the background art do not constitute an admission that the art forms a part of the common general knowledge of a person of ordinary skill in the art. The above references are also not intended to limit the application of the apparatus, systems, devices and methods as disclosed herein.

SUMMARY

In a first aspect there is disclosed a check valve comprising: a valve body defining a fluid flow path and provided with a valve seat; a valve member located in the valve body; and a coupling mechanism coupling the valve member to the valve body, the coupling mechanism arranged to allow the valve member to move linearly in an axial direction relative to the valve body onto and off of the valve seat and maintain a fixed rotational relationship with the valve body.

In one embodiment the coupling mechanism comprises one or more engagement parts supported by one of the valve body and the valve member and one or more recesses on the other of the valve body and the valve member for receiving the engagement parts.

In one embodiment the engagement parts on the valve body and valve member comprise respective sets of circumferentially alternating splines and recesses, wherein the splines on the valve body reside in recesses of the valve member and the splines on the valve member reside in recesses of the valve body, and wherein the splines wherein at least one of the splines is provide with axial channels through which liquid can flow.

In one embodiment the valve body is of generally tubular configuration having an inner circumferential surface and the valve seat comprises a portion of the inner circumferential surface.

In one embodiment the valve member comprises a valve stop having a circumferential surface configured to seal against the valve seat and wherein one of the valve seat and the valve stop circumferential surface is tapered.

In one embodiment the valve stop circumferential surface is tapered.

In one embodiment the valve seat has a substantially constant inner diameter.

In one embodiment the valve stop comprises a plurality of holes through which a liquid can flow when the check valve is in the open configuration.

In one embodiment the check valve comprises a retaining ring coupled to the valve body and wherein the coupling mechanism is located between the valve seat and the retaining ring and the retaining ring is configured to prevent passage thereof through the coupling mechanism.

In one embodiment the check valve comprises a centralizing system configured to substantially centralize the valve member within the valve body while moving in the axial direction.

In one embodiment the check valve comprises a bull nosed cap at an end of the valve member.

In one embodiment the check valve comprises centralizing system configured to substantially centralize the valve member within the valve body while moving in the axial direction wherein the centralizing system comprises an outer peripheral surface which lies adjacent the inner circumferential surface of the valve body and a plurality of flow channels formed in outer peripheral surface enabling fluid to flow across the band.

In one embodiment the check valve comprises a data acquisition system retained in the valve member.

In one embodiment the data acquisition system is a core orientation system.

In one embodiment the data acquisition system is capable of acquiring down hole survey data.

In one embodiment the check valve comprises an electrical power generation component located within or attached the valve member.

In one embodiment the electrical power generation component is an electrical coil.

In one embodiment the electrical power generation component comprises (a) piezo electric material; or (b) a turbine and an electric generator; or (c) a thermocouple.

In one embodiment the check valve comprises an electrical power storage device located within the valve member and electrically coupled to the electrical power generation component.

In one embodiment the electrical power storage device comprises at least one of a rechargeable battery or a super capacitor.

In the same aspect there is disclosed an inner core barrel assembly comprising: a head assembly, a core tube and a spindle, the spindle coupling the head assembly to the core tube in a manner wherein rotary motion of the head assembly about an axis of the inner core barrel assembly is decoupled from the core tube; a check valve according to the first aspect, wherein the valve body is coupled between the head assembly and the inner core tube, the check valve configured to: allow fluid to flow through the inner core tube in a first direction toward the head assembly and out of the inner core barrel assembly; and, prevent fluid flow into the inner core barrel assembly and out of the core tube in a second direction being opposite to the first direction.

In a second aspect there is disclosed a data acquisition system comprising: a valve body defining a fluid flow path; a valve seat within the valve body extending about the fluid flow path; a valve member located in the valve body and movable under influence of pressure differential across the valve body between a closed position where the valve member forms a substantial seal with the valve seat, and an open position with a valve member is spaced from the valve seat; the data acquisition system having one or more sensors housed within the valve member for acquiring data pertaining to a physical condition exterior of the valve member.

In one embodiment the physical condition includes the orientation in three-dimensional space of the valve member.

In one embodiment the data acquisition system comprises an electrical power generation component located within or attached the valve member.

In one embodiment electrical power generation component is an electrical coil.

In one embodiment the electrical power generation component comprises piezo electric material.

In one embodiment the data acquisition system comprises an electrical power storage device located within the valve member and electrically coupled to the electrical power generation component.

In one embodiment the electrical power storage device comprises at least one of a rechargeable battery or a super capacitor.

In one embodiment the valve member is arranged to move in an axial direction being parallel to a direction of fluid flow through the fluid flow path and fixed against rotation about the axial direction.

In one embodiment the data acquisition system comprises a coupling mechanism which couples the valve member to the valve body, the coupling mechanism arranged to allow the valve member to move linearly in the axial direction onto and off of the valve seat and maintain a fixed rotational relationship with the tubular body.

In one embodiment the data acquisition system comprises the one or more engagement parts are supported by the body.

In one embodiment the data acquisition system comprises a centralizing system configured to substantially centralize the valve member within the valve body while moving in the axial direction.

In a third aspect there is disclosed an inner core barrel assembly comprising: a head assembly, a core tube and a spindle, the spindle coupling the head assembly to the core tube in a manner wherein rotary motion of the head assembly about an axis of the inner core barrel assembly is decoupled from the core tube; a check valve located between the spindle and the core tube, the check valve configured to: allow fluid to flow through the core tube in a first direction toward the head assembly and out of the inner core barrel assembly; and, prevent fluid flow into the inner core barrel assembly and out of the core tube in a second direction being opposite to the first direction; and at least one part of a data acquisition system located within the check valve.

In one embodiment the check valve comprises a valve seat and a valve member, wherein the at least one part of the data acquisition system is located within the valve member. In this embodiment the valve body is coupled between the head assembly and the inner core tube.

In one embodiment the inner core barrel assembly comprises an electrical power storage device located in or attached to the valve member.

In one embodiment the inner core barrel assembly comprises an electrical power generation system located in the core tube and arranged to deliver electrical power to the electrical storage device.

In one embodiment the electrical power generation system includes an electrical power generation component located within or attached the valve member.

In one embodiment the inner core barrel assembly comprises a coupling mechanism which couples the valve member to the core tube, the coupling mechanism arranged to allow the valve member to move linearly in the axial direction onto and off of the valve seat and maintain a fixed rotational relationship with the core tube.

BRIEF DESCRIPTION OF THE DRAWINGS

Notwithstanding any other forms which may fall within the scope of the check valve, data acquisition system, and inner core barrel assembly set forth in the Summary, specific embodiments will now be described, by way of example only, with reference to becoming drawings in which.

DETAILED DESCRIPTION

Figure 1A:
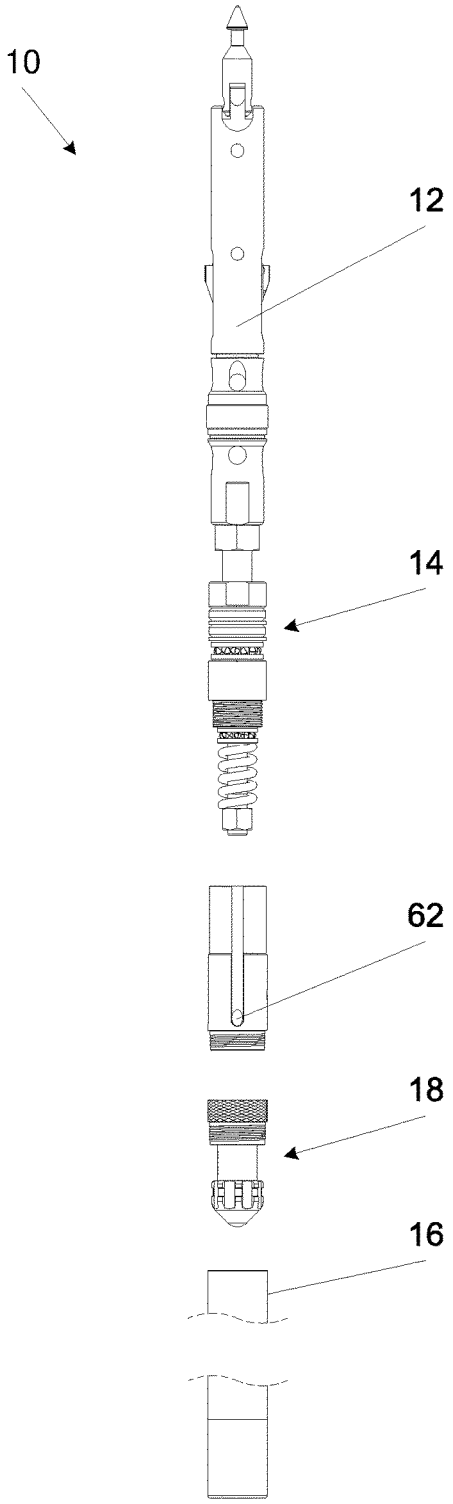
FIG. 1*a* is a partial exploded view of an inner core barrel assembly incorporating a first embodiment of the disclosed check valve.
Figure 1B:
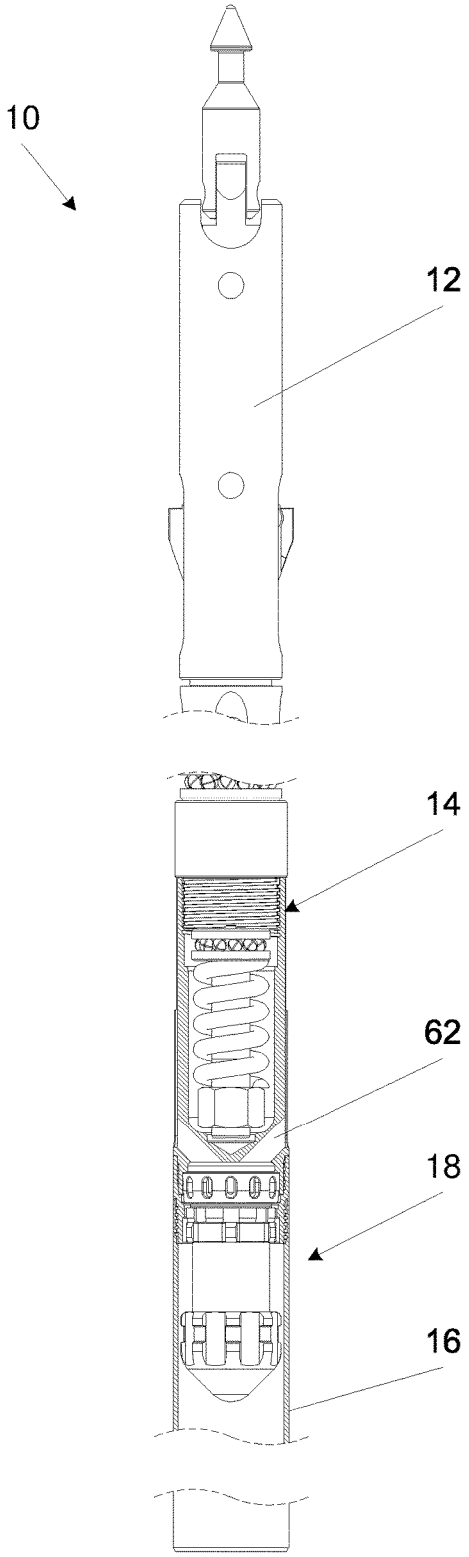
FIG. 1*b* is a partial cutaway view of the inner core barrel assembly and check valve shown in FIG. 1*b*

FIGS. 1*a* and 1*b* provide schematic representations of a portion of an inner core barrel assembly 10. The inner core barrel assembly 10 has: a head assembly 12 at an up hole end which includes a swivel 14; and an inner core tube 16. The swivel 14 couples the core tube 16 to the remainder of the head assembly 12 in a way which decouples a transfer of torque from the head assembly 12 to the inner core tube 16. A check valve 18 is incorporated in the inner core barrel assembly 10 and located between the swivel 14 and the inner core tube 16.

Referring in addition to FIGS. 2-4*a*, the check valve 18 has a valve body 20 and a valve member 22. The valve body 20 defines a fluid flow path FP and is provided with a valve seat 24. The valve body 20 is generally tubular in configuration although it has multiple inner and outer surface portions of different diameters. The body 20 also functions as a coupling for coupling the inner core tube 16 to the head assembly 12.

Figure 4B:
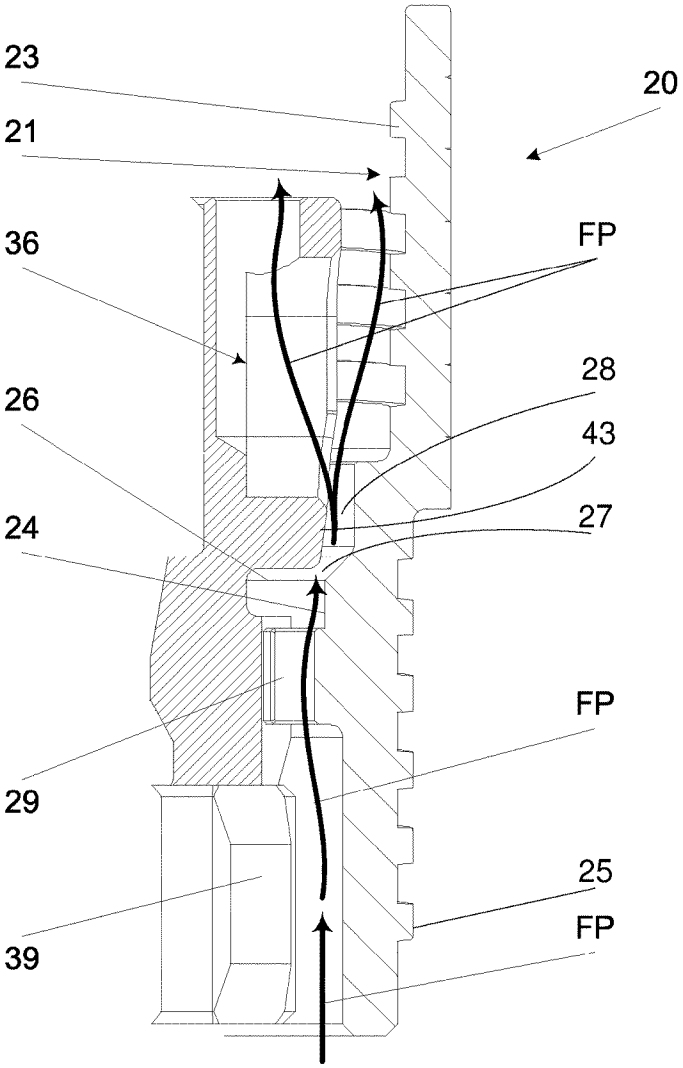
FIG. 4*b* in an enlarged view of a portion check valve shown in FIG. 4*a;*

With particular reference to FIG. 4*b* the valve body 20 has an inner circumferential surface 21. An internal thread 23 is formed on the circumferential surface 21 at the up hole end of the body 20 for connecting to a part of the head assembly 12. An external screw thread 25 is formed at an opposite end of the body 20 or connecting to the inner core tube 16. The valve seat 24 is formed as a circumferential band of reduced diameter on the inner circumferential surface 21. More particularly the valve seat 24 includes an edge 26 which forms a transition with a tapered inner circumferential portion 27. The portion 27 leads to a circumferential band 28 of constant inner diameter, which is larger than the diameter of the seat 24 and edge 26. The thread 23 is formed in a portion of the inner circumferential surface 21 that has a greater inner diameter than that of the band 28.

Figure 2:
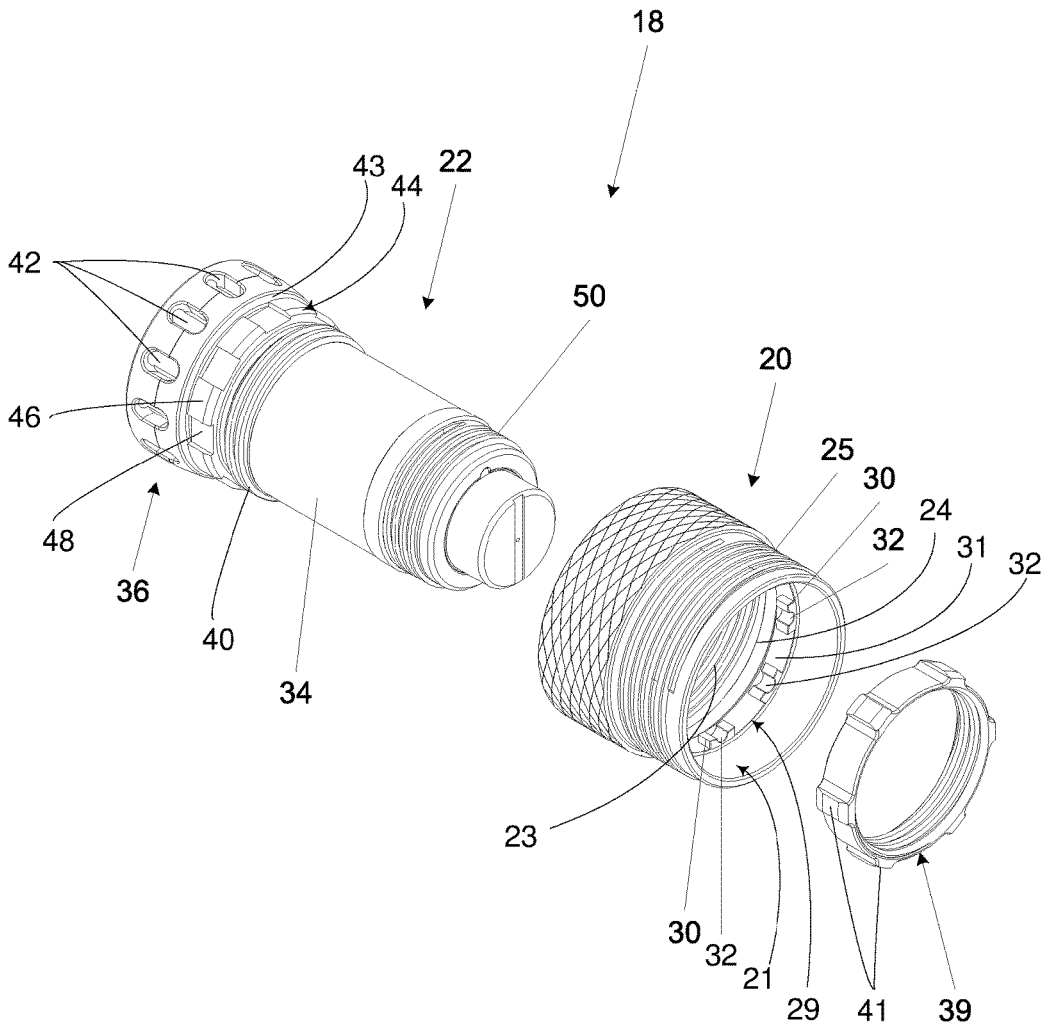
FIG. 2 is an exploded view showing some of the components of an embodiment of the disclosed check valve.
Figure 3B:
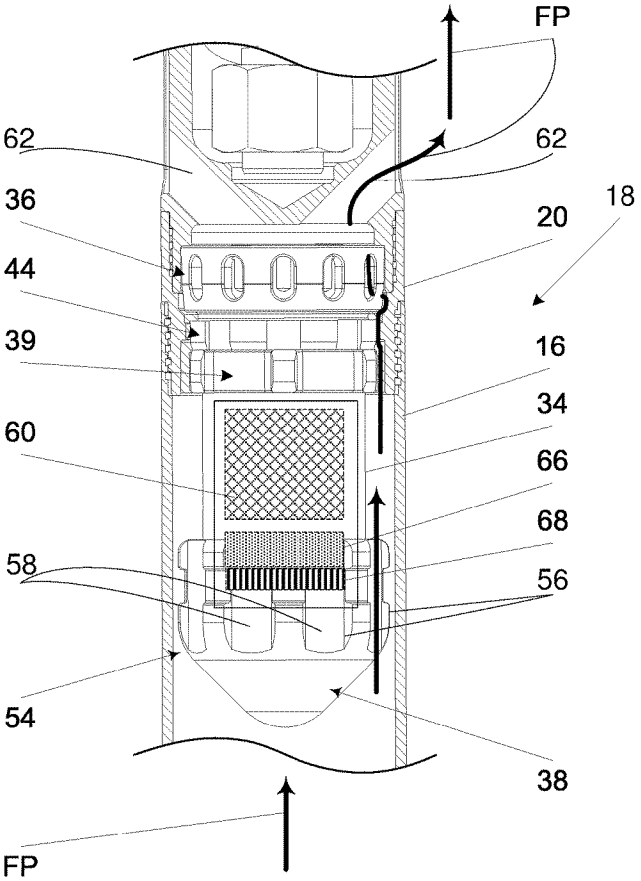
FIG. 3*b* is an enlarged section view of the disclosed check valve assembled into the inner core barrel assembly as shown in FIG. 1*b;*
Figure 3A:
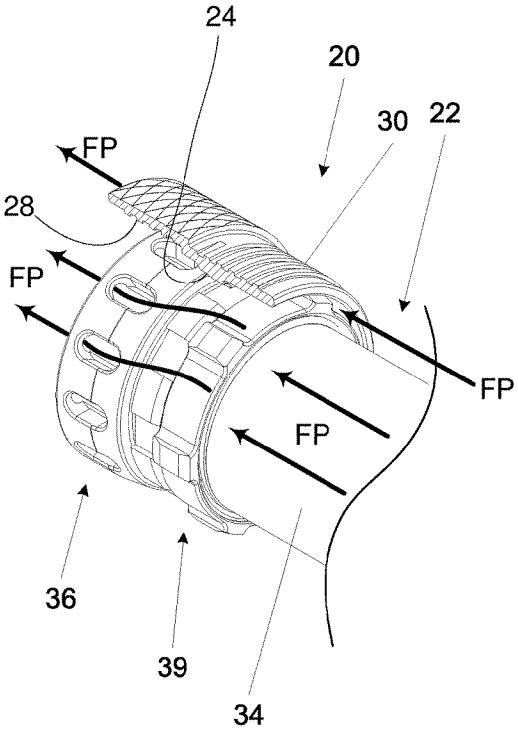
FIG. 3*a* is an isometric cutaway view of a portion of the disclosed check valve shown in FIGS. 1*a*-2.

On a side of the seat 24 opposite the tapered portion 27 the valve body 20 is provided with a spline band 29 (also shown in FIG. 2). The spline band 29 is formed with a plurality of spline pairs 30 which are circumferentially spaced apart from adjacent spline pairs 30 by respective intervening recesses 31. An axial channel 32 extends between the individual splines in each spline pair 30. The valve member 22 has a central tubular body 34 with a valve plug 36 attached at one end and a bull nose cap 38 at an opposite end 50. A retaining ring 39 is screwed onto a thread 40 on the body 34 when the valve 18 is assembled. The ring 39 is on a side of the spline band 29 opposite the stop 36. Ring 39 is formed with spaced apart ribs 41 on its outer circumferential surface. The space between the ribs 41 allows fluid to flow on the outside of the ring 39. The ribs 41 may also act to centralize the valve member 22 within the body 20.

The stop 36 is in the form of a circumferential ring that also screws onto the body 34 and is formed with a plurality of spaced apart holes 42. The holes 42 are inboard of opposite axial edges of the valve stop 36. The stop 36 is also formed with a tapered or chamfered circumferential edge 43. As shown most clearly in FIGS. 4*b* and 5*b* the tapered edge 43 is designed to form a substantial seal against the valve seat 24 and in particular the edge 26 when the valve 18 is in the closed configuration.

The check valve 18 has a coupling mechanism 37 coupling the valve member 22 to the valve body 20, the coupling mechanism arranged to allow the valve member 22 to move linearly in an axial direction relative to the valve body 20 onto and off of the valve seat 24 and maintain a fixed rotational relationship with the valve body 20. The coupling mechanism 37 comprises one or more engagement parts supported by one of the valve body 20 and the valve member 22 and one or more recesses on the other of the valve body and the valve member for receiving the engagement parts. In this embodiment the coupling mechanism 37 comprises the combination of the spline band 29 and a body spline ring 44. As will be apparent the retaining ring 39 is configured to prevent passage thereof through the coupling mechanism 37.

The body spline ring 44 lies adjacent the stop 36. The spline ring 44 is formed with alternating splines 46 and recesses 48. In the assembled valve 18 spline ring 44 engages with the spline band 29. In particular the splines 46 reside in the recesses 31 while the spline pairs 30 located within the recesses 48. This enables the valve member 22 to slide axially relative to the valve body 20 prevent relative rotation. The engagement of the spline ring 44 with the spline band 29 also assists in maintaining axial alignment of the valve member 22 with the body 20 and guiding the tapered edge 43 onto the valve seat 24.

A cap 38 is screwed onto a thread 50 the end of the housing 38 opposite the stop 36. The cap 38 in this embodiment has a rounded nose 52, (which may also be referred to as a "bull nose") which increases in outer diameter in a direction toward the ring 39 (i.e. in the up hole direction). This leads to a centralizing portion 54 which assists in centralizing the valve member 22 within the valve body 20. The centralizing portion 54 is formed with an outer peripheral surface having a plurality of alternating splines 56 and flow channels 58. By virtue of the splines 56 the outer peripheral surface has an outer diameter slightly smaller than the inner diameter of the inner core tube 16. The flow channels 58 in the outer peripheral surface provide paths for liquid within an inner tube 16 to flow as the inner core barrel assembly 10 descends through a drill string. The splines 56 also facilitate convenient engagement with a spanner or other hand tool for tightening or indeed unscrewing the cap 38.

A potential benefit of the rounded nose cap 38 is that fluid pressure acting in the uphole direction is applied more uniformly across the surface area of the cap providing more reliable operation (i.e. opening) of the valve member 22 and thus avoiding a build-up of pressure in the core. Internal electronics/sensors (not shown) may also be provided to sense and alert a user that the check valve has seized making it dangerous to decouple the check valve and core tube from the inner core barrel assembly 14 and 12. These electronic/sensors together with a data acquisition system 60 (discussed below) may also be protected from damage by the cap 38 in the event of contact with a core sample.

A data acquisition system 60 (see FIG. 3*b*) for acquiring data pertaining to a physical condition exterior of the valve member is housed in a sealed cavity within valve member 22. The cavity may partly be formed in tubular body 34 and partly in the cap 38 which screws onto the tubular body 34. An electrical power storage device 66 is also retained within the tubular body 34. The device 66 may be part of or separate to the system 60 but in either case provides electrical power for the functioning and operation of the system 60. Storage device 66 may be formed including, but not limited to, a battery or a super capacitor.

The power storage device 66 may be changed from time to time as required by simply removing the cap 38. Alternately, the power storage device 66 may be of a form that can be recharged. In this event the power storage device 66 may be recharged either: at the surface by plugging into a mains power supply or a generator; or down the hole using a power generation component 68 that is located within or attached to the valve member 22.

The power generation component 68 may be arranged to generate electrical power utilizing forces and/or motion that arises as a matter of course in the operation of the core drill. For example one possible form of the power generation component 68 may be one or more pieces of piezo electric material held within the housing 34. Vibrations generated during the operation of the core drill, or motion/acceleration associated with the inner core barrel assembly 10 being tripped in the drill string can be coupled to the piezo electric material to cause the piezo electric material to generate electricity for recharging the power storage device 66.

The data acquisition system 60 for acquiring data pertaining to a physical condition exterior of the valve member may comprise one or more systems, devices and sensors for measuring, detecting or otherwise acquiring information pertaining, but not limited to, one or more of the following:

- the orientation in three-dimensional space of the valve member 22;
- the immediate physical environment including any one, or combination of two or more, of: temperature, pressure and vibration);
- flow rate of fluid through the fluid flow path FP;
- gamma radiation from surrounding strata;
- borehole survey;
- magnetic field strength and direction;
- borehole orientation and direction including dip and azimuth;
- core orientation of a core sample cut by the core drill and captured in the inner core tube 16;
- rotation of drill rods and/or an outer core barrel of an associate core drill relative to the inner tube;
- time of rotation of rods.

Thus in one example the data acquisition system 60 may comprise a core orientation system. An example of a commercially available core orientation system suitable for installation in the housing 34 of the valve member 22 is the REFLEX ACT III orientation system details of which can be found at http://reflexnow.com/act-III/. However other orientation systems may be incorporated in the valve member 22.

The specific nature and brand of the data acquisition system 60 is not material to embodiments of the disclosed check valve 18. However when the data acquisition system 60 is performing core orientation or a down hole survey it is important that such systems that remain rotationally fixed to the inner core tube 16 (and therefore the core sample which is fed into and retained in the inner core tube 16). As will be evident from the above description the present check valve 18 ensures that the valve member 22 and therefore enclosed data acquisition system 60 is maintained in a rotationally fixed relationship with the core sample and core tube 16. This is due to the engagement of the spline ring 44 of the spline band 29.

As shown in FIGS. 1*b*, 3*b*, 4*a* and 4*b* the inner core barrel assembly 10 is provided with a plurality of bypass passages 62 through which fluid flowing along the flow path FP can flow after passing through the check valve 18. The bypass passages 62 are inclined relative to a central axis of the valve body 20 and inner core tube 16. When the assembly 10 is descending through a liquid filled portion of the drill string, the bypass channel 62 allow the fluid flowing through the flow path FP to flow out of the assembly 10 which assists in increasing the speed of descent of the assembly 10. This in turn reduces the time taken for a core run and thereby increases productivity.

The general operation of the check valve 18 will now be described with particular reference to FIGS. 4*a*-5*b* along with FIG. 2.

Figure 4A:
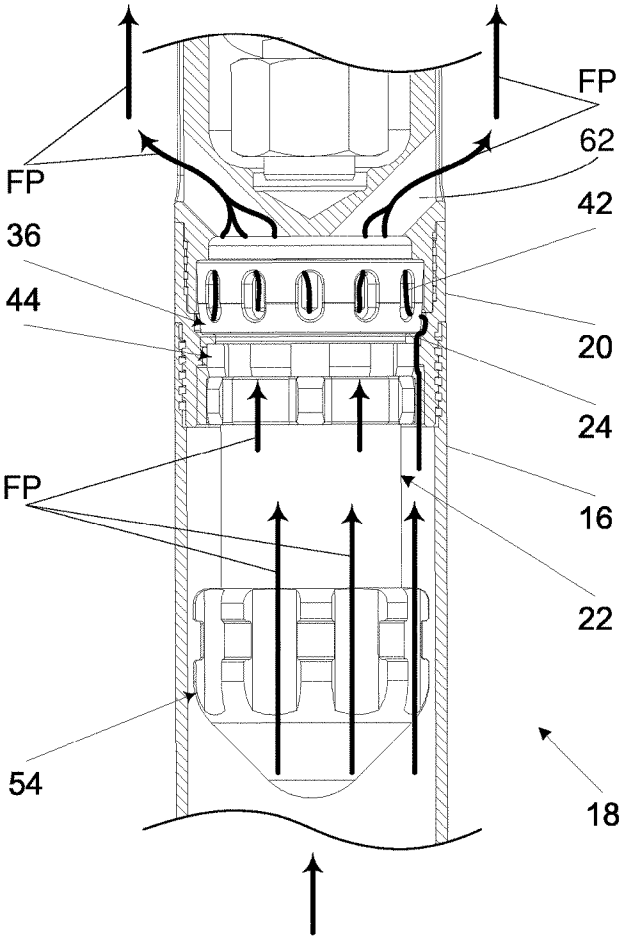
FIG. 4*a* is a representation of a portion of the inner core barrel assembly comprising a part of a grease cap together with the valve body and valve member shown in FIG. 3, and with the check valve in the open state or configuration.
Figure 5B:
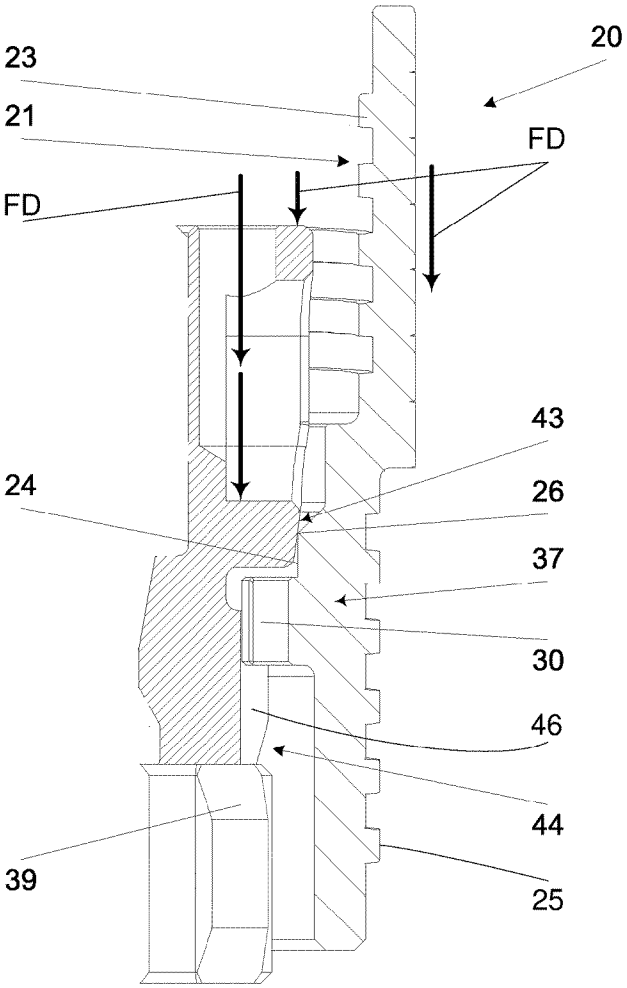
FIG. 5*b* is and enlarged view of a portion of the check valves shown in FIG. 5*a*.
Figure 5A:
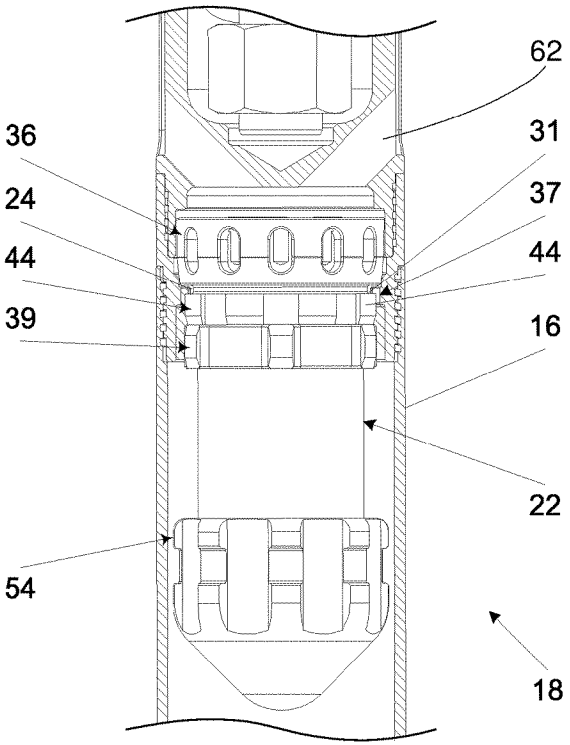
FIG. 5*a* is a schematic representation of the check valve shown in FIGS. 4*a* and 4*b* but now in a closed configuration.

FIGS. 4*a* and 5*a* shows a check valve 18 in the open condition or state as the inner core barrel assembly 10 is descending through a fluid filled part of a drill string. For ease of reference this discussion is made in terms of the fluid flowing upwardly through the descending assembly 10. In reality the fluid is in essence stationary and it is the assembly 10 that is moving, but the effect of the relative motion of fluid and assembly 10 is the same.

During the descent of the assembly 10 liquid in the core tube 16 applies pressure to the face of the bull nose cap 38 as it flows along the fluid path FP. This displaces the valve member 22 axially in an up hole direction relative to the valve body 20 direction so that the valve stop 36 is lifted off the valve seat 24. This is shown most clearly in FIG. 4*b*. The axial displacement is guided by the engagement of the spline ring 44 with the spline and band 29 which also as previously described maintains a fixed rotational relationship between the valve member 22 and the valve body 20. The liquid is able to pass through the mating ring 44 and band 29 by virtue of the channels 32 in the spline pairs 30. This ensures that the flow path FP remains open when the valve stop 36 and the tapered edge 43 lifted from the valve seat 24. The fluid path FP extends between the valve seat 24 and the tapered edge 43. The fluid path FP may also bifurcate so that liquid also passes through the holes 42 in the stop 36.

The descent of the assembly 10 ceases when it engages a landing shoulder (not shown) inside an outer core barrel assembly and latches to the outer core barrel assembly. As it is now no relative movement between the assembly 10 and liquid within the inner core tube 16 the valve member 22 now slide axially in the downhole direction relative to the valve body 20 so that the tapered edge 43 of the stop 36 engages with the edge 26 of the valve seat 24. This is the closed configuration of the valve 18 shown in FIGS. 4*b* and 5*b*.

Typically the next stage in core drilling will be to activate a pump at the surface to pump a liquid such as water and/or drilling mud through the drill string along a downhole path FD (see FIG. 5*b*). This liquid is able to flow through into the bypass passages 62 thereby applying pressure on to the up hole end of the valve member 22 directly as well as onto an inside surface of the stop 36 by the holes 44. This forces the valve member 22 onto the valve seat 24 with the tapered edge 43 engaging the edge 26 of the seat 24 and thereby positively holding the check valve 18 in the closed configuration.

This liquid cannot pass in the downhole direction through the check valve 18 and is now limited to only flowing between the outside of the core inner tube 16 and an inner surface of the outer core barrel assembly to reach a core bit at the end of the drill string/outer barrel assembly and flow into the hole being drilled.

The data acquisition system 60 within the check valve 18 may be used to acquire core orientation data during drilling, after the cessation of drilling and for a core breaking operation, and retrieval of the inner core barrel assembly 10. There will be a high degree of confidence that the orientation measurements taken by the system 60 can be correlated with the actual core sample within the inner core tube 16 because of the fixed rotational relationship between the valve member 22 and the inner core tube 16.

Figure 6:
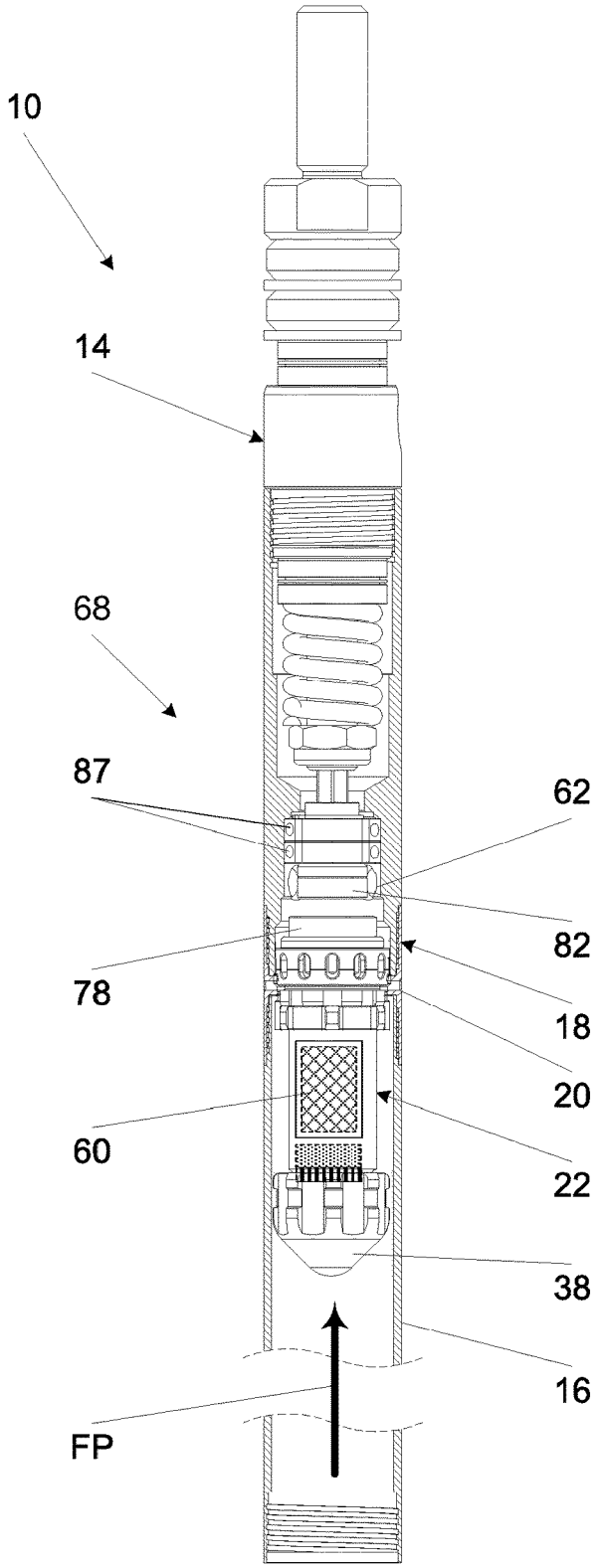
FIG. 6 is a schematic representation of a second embodiment of the disclosed check valve and associated inner core barrel assembly.

FIG. 6 depicts an embodiment of the check valve 18 with an alternate form of power generation system for generating power down the hole to recharge the power storage device 66. In this embodiment the power generation system 68 is in the form of an inductively coupled electric generator 80. The power generation system includes a permanent magnet 82 which is held within a grease cap or small sub 84 coupled between the valve body 20 and the head assembly 12. The magnet 82 is supported on a drum 86 which in turn is coupled by bearings 87 to the cap/sub 84 which allows the magnet 82 and drum 86 to rotate about an axis of the inner core barrel assembly 10.

The spindle 14 in this embodiment is slightly modified over the previous embodiment by the inclusion of a shaft 88 which is keyed at an up hole end to the a portion of the head assembly 12. The shaft 88 is able to rotate with the head assembly 12 as the drill string rotates. However the spindle 14 otherwise functions in the same manner as the spindle described above in terms of rotationally decoupling the head assembly 12 from the inner core tube 16. When the drill string rotates, the shaft 88 rotates thereby rotating the magnet 82. This creates a varying magnetic field. The magnetic field couples with the power generation component 78 which in this instance is in the form of an electrical coil. This in turn generates an electrical current in the electrical coil. This current may be initially fed to an electrical filtering or rectification circuit on a PCB on which the electrical coil is mounted. In any event the current generated in the electrical coil is electrically coupled to the power storage device 66.

Both the above described methods of generating electrical power down the hole to recharge the power storage device 66 may also be used to provide an indication of the core sample being broken from the in situ strata. This arises because in the core breaking operation the drill string is not rotated. As a consequence of this lack of rotation there will be both a change in the vibration pattern and of course the event of the use of the electric generator 80 no rotation of the magnet 82. This is manifested by a detectable variation in the generation of electrical power/current in or by the component 68. This variation may be used to indicate the imminence of the core breaking operation. Additionally this variation may be used to trigger the data acquisition system to commence logging of data.

In the above described embodiments the check valve 18 can be considered to be a data collection check valve or an orientating check valve in the case that the data collection system 42 is arranged to measure core orientation. Alternately the combination of the check valve 18 and the data acquisition system 60 may be considered as constituting a downhole data collection system with check valve functionality.

Whilst a number of specific embodiments have been described, it should be appreciated that the check valve, downhole data collection system 60 and inner core barrel assembly 10 may be embodied in many other forms. For example two power generation systems have been described above, one using piezo electric material and the other an electric generator. However other power generation systems are possible. These include systems which generate power via liquid flow or temperature differential.

For example with reference to FIG. 6 a small electric generator and turbine may be attached to the end of the housing 34 near the power storage device 66. When the inner core barrel assembly 10 is descending through a drill string/borehole containing a liquid such as water turbine is rotated as water flows through the flow path FP and out of the passages 62. During this time the associated generator will produce current to recharge the power storage device 66. In this way the storage device 66 is recharged on every core run when there is liquid in the drill string.

Temperature differential can also be used to recharge the power storage device 66 by use of a thermocouple having ends which are subject to different temperatures. The different temperatures may be those between for example ground level and at the toe of the bore hole, or to temperature differential between a lower part of the borehole filled with a liquid and an upper part which is not.

In further variation the valve seat 24 may be formed with a tapered surface instead of the providing the tapered edge 43 on the stop 36; or both the seat 24 and the edge can be tapered. Also while the spline pairs 30 are shown with flow channels 32, alternately or additionally the splines 46 on the spline ring 44 can be provided with flow channels to allow the axial flow of liquid along path FP.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the apparatus and method as disclosed herein

What is claimed is:

1. A downhole data collection system comprising:

a valve body defining a fluid flow path in an inner core barrel assembly;

a valve seat within the valve body extending about the fluid flow path;

a valve member located in the valve body and movable under influence of pressure differential cross the valve body between a closed position wherein the valve member forms a substantial seal with the valve seat, and an open position wherein the valve member is spaced from the valve seat;

data acquisition system housed within the valve member, the data acquisition system configured to acquire data pertaining to at least one physical condition exterior of the valve member; and a coupling mechanism which couples the valve member to the valve body, the coupling mechanism arranged to allow the valve member to move linearly in an axial direction relative to the valve body on to and off of the valve seat and maintain a fixed rotational relationship with the valve body.

2. The downhole data collection system according to claim 1, wherein the at least one physical condition is selected from the group consisting of:

a. Orientation in three-dimensional space of the valve member;
b. Temperature
c. Pressure
d. vibration
e. Flow rate of fluid through a fluid flow path;
f. Gamma radiation from a strata surrounding the valve member
g. Bore hole survey
h. Magnetic field strength and direction;
i. Borehole orientation and direction
j. Core orientation of a core sample
k. Rotation of drill rods
l. Time of rotation of drill rods.

3. The downhole data collection system according to claim 1, wherein the data acquisition system is configured to acquire down hole survey data.

4. The downhole data collection system according to claim 1, wherein the data acquisition system comprises a core orientation system.

5. The downhole data collection system according to claim 1, wherein the valve member incorporates a tubular body and further comprising an electrical power storage device housed within the tubular body.

6. The downhole data collection system according to claim 5, further comprising a power generation component located within or attached to the valve member.

7. The downhole data collection system according to claim 6, wherein the electrical power generation component is an electric coil.

8. The downhole data collection system according to claim 6, wherein the electrical power generation component comprises (a) piezo electric material; or (b) a turbine and an electric generator, or (c) a thermocouple.

9. The downhole data collection system according to claim 6, wherein the electrical power storage device is electrically coupled to the electrical power generation component.

10. The downhole data collection system according to claim 6, wherein the electrical power storage device is a rechargeable battery or a super capacitor.

11. The downhole data collection system according to claim 1, wherein the valve member is arranged to move in an axial direction being parallel to a direction of fluid flow through the fluid flow path.

* * * * *